US006360755B1

(12) United States Patent
Schantz et al.

(10) Patent No.: US 6,360,755 B1
(45) Date of Patent: Mar. 26, 2002

(54) METHOD FOR PROCESSING SEMICONDUCTOR MATERIAL

(75) Inventors: Matthäus Schantz, Reut; Dirk Flottmann, Altötting, both of (DE)

(73) Assignee: Wacker-Chemie GmbH, Munich (DE)

( * ) Notice: Subject to any disclaimer, the term of this patent is extended or adjusted under 35 U.S.C. 154(b) by 0 days.

(21) Appl. No.: 09/362,462

(22) Filed: Jul. 28, 1999

(30) Foreign Application Priority Data

Jul. 30, 1998 (DE) ..... 198 34 447

(51) Int. Cl.[7] ..... C25F 3/30

(52) U.S. Cl. ..... 134/1.3; 134/1; 134/17; 134/22.12; 134/22.18; 134/37; 241/1; 241/24.1

(58) Field of Search ..... 241/1, 24.1; 134/1, 134/1.3, 17, 22.12, 22.18, 37

(56) References Cited

U.S. PATENT DOCUMENTS

| | | | | |
|---|---|---|---|---|
| 4,313,573 A | * | 2/1982 | Goldberger et al. | 241/1 |
| 5,082,502 A | | 1/1992 | Lee et al. | 134/1 |
| 5,464,159 A | | 11/1995 | Wolf et al. | 241/1 |
| 5,826,806 A | | 10/1998 | Hafmann | 241/1 |
| 6,033,994 A | * | 3/2000 | Tikhonov | 438/746 |

FOREIGN PATENT DOCUMENTS

| | | |
|---|---|---|
| DE | 19534 232 | 3/1997 |
| DE | 19545579 | 6/1997 |
| DE | 197 49 127 | 5/1999 |
| EP | 0573855 | 12/1993 |
| WO | 86/06652 | 11/1986 |

OTHER PUBLICATIONS

Derwent Abstract (# 1997–180848 [17]) corresponding to DE 195 34 232.

English Derwent Abstract [1999–303623[26]] corresp. to DE 197 49 127 A1.

* cited by examiner

*Primary Examiner*—Randy Gulakowski
*Assistant Examiner*—Michael Kornakov
(74) *Attorney, Agent, or Firm*—Collard & Roe, P.C.

(57) ABSTRACT

A method is for processing semiconductor material, in which one or more shock waves generated using a transducer are transmitted through a liquid medium to semiconductor material in rod form. The transducer is at a distance of from 1 cm to 100 cm from the semiconductor material, and the shock waves have a pulse energy of from 1 to 20 kJ and a pulse rise time to the energy maximum of from 1 to 5 $\mu$s.

8 Claims, 1 Drawing Sheet

METHOD FOR PROCESSING SEMICONDUCTOR MATERIAL

BACKGROUND OF THE INVENTION

1. Field of the Invention

The present invention relates to a method for processing semiconductor material.

2. The Prior Art

Ultrapure semiconductor material is required for the production of solar cells or electronic components, for example memory elements or microprocessors. Silicon is the most commonly used semiconductor material in the electronics industry. Pure silicon is obtained by thermal decomposition of silicon compounds, for example trichlorosilane, and this pure silicon is often in the form of polycrystalline crystal ingots. The crystal ingots are needed as starting material, for example, for the production of single crystals. For the production of single crystals using the Czochralski method, the crystal ingots firstly need to be comminuted into fragments. The fragments are melted in a crucible and the single crystal is then pulled from the resulting melt. In the best possible case, the only contamination in the semiconductor material should then be the dopant deliberately introduced into the semiconductor material. Various methods for the comminution of crystal ingots have already been proposed, the purpose of which is to minimize the contamination of the semiconductor material.

EP-573,855 A1 (corresponding to U.S. Pat. No. 5,464,159) comprehensively describes the problems occurring in relation to the comminution of semiconductor materials, as well as various solutions that have already been proposed. EP-573,855 A1 discloses a method in which a crystal ingot is broken up using focused shock waves. In this case, through the repeated action of shock waves on the semiconductor material. This material is comminuted until the fragments of the semiconductor material are smaller than the minimum desired limiting size of the fragments.

All known comminution methods have the disadvantage that the size and weight distributions of the fragments cannot be adjusted in a controlled way through process parameters.

It has also been shown that, in contrast to what EP-573,855 A1 describes, gradual comminution by repeated application of low-energy shock waves is not suitable for the comminution of semiconductor material. This is because it is not possible to re-focus each individual fragment and reduce its size even further. A further aspect of this type of continued comminution is that an undesirably large proportion of small fragments is obtained. Further, the variability of the adjustment of fragment size classes is restricted.

If a crucible is filled with polycrystalline silicon fragments which are too large, then this crucible for pulling single crystals will have a comparatively small fill factor. Thus this crucible will not therefore contain enough material for pulling a single crystal having the requisite or desired size. Fragments which are too large also increase the time taken for melting in the crucible, which can in turn lead to undesired contamination. Fragments which are too large must therefore have their size reduced further in order to avoid these disadvantages.

Fragments which are too small are more easily contaminated because of their large surface area, and therefore require expensive removal of impurities. For this reason, small fragments and fine dust, which are created during the comminution of polysilicon ingots, are not used for the production of single crystals. Instead, they are used, for example, for the production of solar silicon.

For the production of monocrystalline semiconductor material by pulling from crucibles, the fragments of the polycrystalline semiconductor material should therefore preferably have a maximum length of 2 to 25 cm. The majority of these fragments should have a maximum length of from 4 to 12 cm.

It is desirable to have a method available for the processing of semiconductor material which makes it possible to comminute the semiconductor material in such a way that the proportion by weight of specific fragments can be adjusted through process parameters. This adjustment process makes it possible to obtain the preferred fragment size distribution for the subsequent processing.

Further, the level of contamination created during the processing should be lower than in the case of conventional size reduction with a hand chisel in rooms with clean classifications higher than 1000.

In the case of conventional size reduction, the resulting average contamination levels are generally 4 ppb of metal on the surface of the polysilicon fragments.

It is also desirable to have a method available which, during the comminution, allows the surface of the semiconductor material to be cleaned and does not introduce any further contamination into the material.

SUMMARY OF THE INVENTION

It is an object of the present invention to provide a method for processing semiconductor material, in which one or more shock waves generated using a transducer are transmitted through a liquid medium to semiconductor material in rod form, wherein the transducer is at a distance of from 1 cm to 100 cm from the semiconductor material, and the shock waves have a pulse energy of from 1 to 20 kJ and a pulse rise time to the energy maximum of from 1 to 5 $\mu$s.

At no time does the transducer come into direct contact with the semiconductor material. From the point where they are created, the shock waves are preferably transmitted through a liquid medium, for example water, and preferably degasified ultrapure water.

Preferably, the transducer is at a distance of from 1 to 12 cm, and particularly preferably from 1.5 to 3 cm, from the surface of the semiconductor material.

Shock waves can, for example, be generated by blasts, electric discharges, or by electromagnetic or piezoelectric means. Preferably, the shock waves have a pulse energy of from 10 to 15 kJ, and particularly preferably from 11 to 13 kJ. Preferably, the shock waves have a pulse rise time to the energy maximum of from 2 to 4 $\mu$s.

Preferably, in the method of the invention only one shock wave, which causes disintegration of the semiconductor material exposed, is used per respectively exposed section of the semiconductor ingot.

The present invention therefore also relates to the use of the method according to the invention for the comminution of semiconductor material.

For the method according to the invention, it is advantageous, but not absolutely necessary, to generate shock waves by electric discharge between two electrodes at the focal point of a semiellipsoidal reflector. The plasma formed during the discharge between the electrodes leads to a spherical shock wave front which propagates at the velocity of sound through the transmitting medium. This shock wave front is reflected by the walls of the reflector then concentrated at the focal point of an imaginary semiellipsoid arranged with mirror symmetry relative to the reflector. The focusing region of the semiellipsoidal reflector lies around this focal point. Preferably, a semiellipsoidal reflector is used as the transducer.

The level of the energy input determines the region in which microcracks are formed and how many microcracks are formed. Therefore, it determines the fragment size.

For example, very brittle frangible material already has a large number of microcracks and merely needs these parts to be broken apart, which can be achieved using an unfocused shock wave.

Focusing of the shock waves onto the semiconductor ingot is generally not required in the case of ingots of currently obtainable materials.

Depending on future material developments, however, it may become necessary to focus the shock waves onto the semiconductor ingot.

When the method according to the invention is used, it is not a small part of the ingot which is comminuted, but instead the entire rod region exposed to the shock wave is uniformly comminuted.

Expediently, a water-filled comminution chamber is provided, which in the simplest case may be a water tank into which the semiconductor material to be comminuted is introduced. The shock waves are injected into the comminution chamber. To that end, the semiellipsoidal reflector is located in the comminution chamber or is mounted on one of its bounding walls. If appropriate, the point where the shock waves are generated may be spatially separated from the semiconductor material by a diaphragm which is impermeable to foreign substances but transmits shock waves, in order to protect it from impurities.

Preferably, from 1 to 20 transducers are used. Particularly preferably, 2, 4, 6, 8, 10, 12, 14, 16, 18 or 20 transducers are used. In particular, 2 transducers are preferably used.

When a relatively large number of transducers (for example more than two transducers) are used, they are preferably arranged along the semiconductor ingot in such a way that a relatively large section of the ingot or the entire semiconductor ingot is processed simultaneously by one pulse.

When one or two transducers are used, the ingot is preferably processed piece by piece with one pulse in each case. Preferably, when a plurality of transducers are used, respective pairs of transducers are arranged at an angle of 180° relative to each other.

Preferably, the comminution of the semiconductor material is carried out at moderate temperatures, for example room temperature. Thus diffusion of superficially adsorbed foreign materials, in particular foreign metals, induced and/or accelerated by high temperatures, is substantially avoided.

The working surfaces of the tools for transporting and positioning the semiconductor material are, in order to preclude the possibility of contamination, preferably made of plastic. Examples of these plastics include polyethylene (PE), polytetrafluoroethylene (PTFE) or polyvinylidene difluoride (PVDF). The working surfaces can also be made of the same material as the actual material to be comminuted. It has also proved favorable to line the internal surfaces of the comminution chamber with plastic.

The method according to the invention makes it possible, for the first time, to use shock wave comminution for the comminution of semiconductor material in such a way that a fragment size distribution of the semiconductor material is obtained which can be adjusted in a controlled way.

The method according to the invention has the advantage that, through the strength and, if appropriate, also the direction of the pulses which act on the crystal surface, a force is exerted through whose action the number and direction of microcracks is influenced. The number and alignment of the cracks along the grain boundaries of the material dictates the shape and size of the newly produced fragments.

However, a further advantage of the method according to the invention is that fragments still lying in the area of effect of the pulse generator do not have their size further reduced by subsequent pulses, so that continued comminution has essentially no effect in this method. The erosion of the ingot support which results from the percussive effect and causes contamination, can be greatly reduced through the geometrical arrangement of the transducers.

It is in this case particularly preferable to have an arrangement in which each pair of transducers are at an angle of 180° to each other with the semiconductor material preferably lying mid-way between the transducers.

It has surprisingly been found that the method according to the invention also causes cleaning of the surface of the semiconductor material if this surface is contaminated with more than 2 ppb of metal.

The present invention therefore also relates to the use of the method according to the invention for the cleaning of semiconductor material.

When the method according to the invention is being carried out, cavitation bubbles are created in the liquid medium as a consequence of the shock waves and bring about a cleaning effect on the surface of the semiconductor material. In addition, oxidizing compounds which are customarily used to clean semiconductor materials are formed in the cavitation bubbles. The liquid in which the method is being carried out will thus contain, depending on the way in which the method is carried out, for example nitrate, nitrite, OH radicals and $H_2O_2$. The total concentration of these compounds is in the $\mu$mol/l to mmol/l range. However, the oxidizing compounds occur in the cavitation bubbles in very high local concentrations, which are in the mol/l range. This is because the compounds are firstly restricted to the cavitation bubbles, that is to say are created there and to some extent also broken down further there. In the method according to the invention, a cleaning effect thus occurs not only through the implosion of the cavitation bubbles on the surface of the semiconductor material. But the cleaning effect also occurs through the cleaning action of the oxidizing compounds which act in high local concentrations on the surface when the gas bubbles break up on the surface of the semiconductor material.

The method according to the invention is suitable for the processing of solid, large-volume bodies of semiconductor material, preferably made up of monocrystalline or polycrystalline silicon. The semiconductor material most preferable is polycrystalline silicon.

With the method according to the invention, it is possible to comminute and, at the same time, clean semiconductor material, in particular silicon, at moderate temperatures and without contact with a fragmenting tool, to form fragments with a maximum length of 110 mm to 250 mm. If there is no, or only minor, superficial contamination of the semiconductor material to be comminuted, the hitherto customary surface cleaning of the fragments, for example by etching, can be reduced or omitted.

The breaking of semiconductor material by means of the method according to this invention leads to a contamination level of less than 2 ppb of metal. Fragments which have been contaminated only by metal dust from the surroundings to a level of 4 ppb of metal are cleaned by the method according to the invention to below 2 ppb of metal. Even in semiconductor material broken by hand in the conventional way, in which the contamination is quite firmly seated in the oxide layer of the polysilicon fragment, cleaning is achieved by the method according to the invention on average to 3 ppb of metal. Further comminution to below the minimum desired particle sizes does not in this case occur insofar as the fragments have already been comminuted by hand to this size range.

BRIEF DESCRIPTION OF THE DRAWINGS

Other objects and features of the present invention will become apparent from the following detailed description considered in connection with the accompanying drawing and example which disclose several embodiments of the present invention. It should be understood, however, that the drawing and the example are designed for the purpose of illustration only and not as a definition of the limits of the invention.

In the drawing, wherein similar reference characters denote similar elements.

DETAILED DESCRIPTION OF PREFERRED EMBODIMENT

Example

Figure 1:
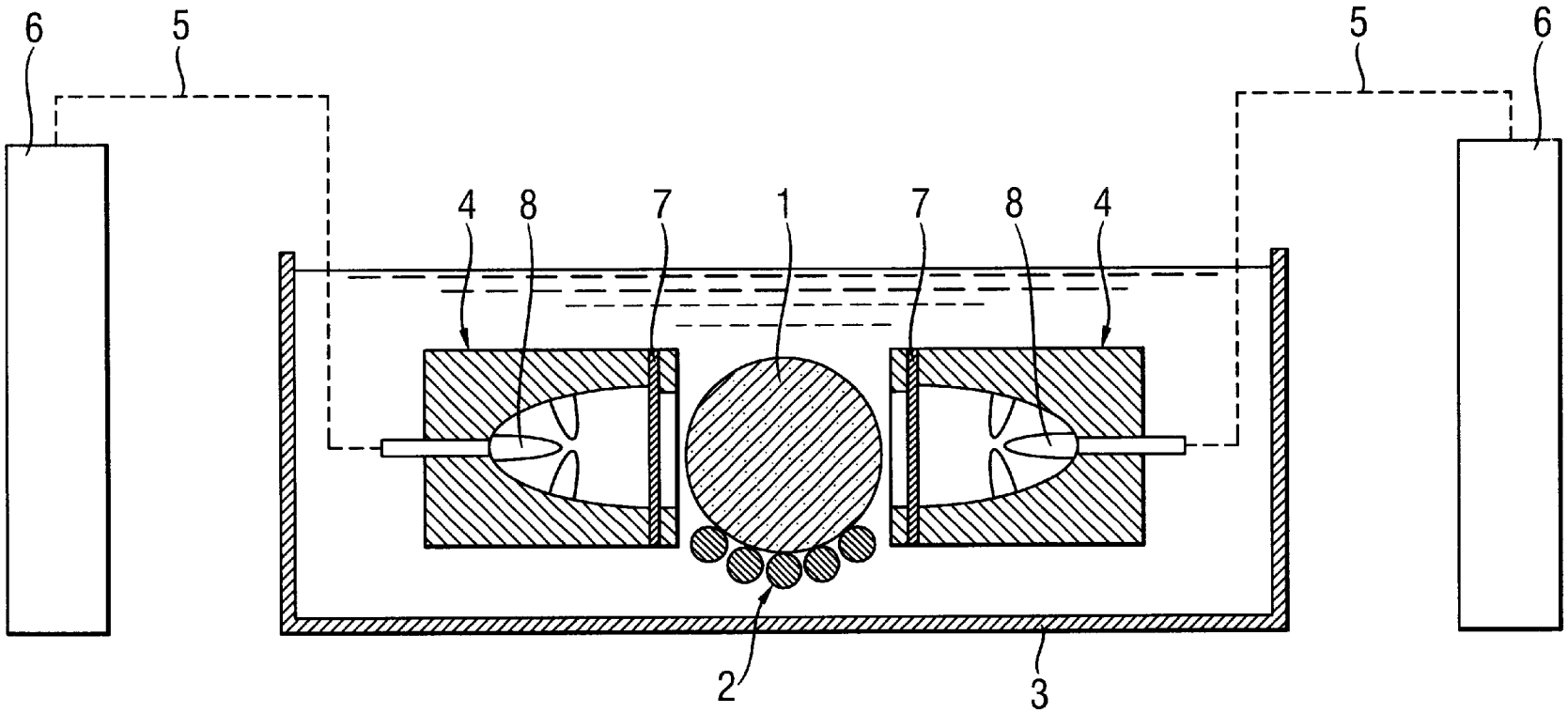
FIG. 1 shows a device for carrying out the method according to the invention, as is used in Example 1.

A piece of a polycrystalline silicon ingot 1 from a deposition system was fully immersed on a support made of polysilicon rods 2 in a water-filled tank 3. At a distance of 2 cm from the ingot surface, two semiellipsoidal reflectors 4 are positioned in such a way that they form an angle of 180° with each other. The silicon ingot 1 is lying mid-way between the semiellipsoidal reflectors. The semiellipsoidal reflectors 4 are connected to the associated power supply devices 6 via supply cables 5.

A shock wave pulse with a pulse energy of 12 kJ and a pulse length of 3 $\mu$s was generated by striking an arc between the electrodes 8 of the semiellipsoidal reflector. The shock wave passes through an elastic diaphragm 7 to the surface of the silicon ingot 1. The position of the ingot in the tank was chosen in such a way that it at least approximately coincided with the focusing area of a semiellipsoidal reflector. The piece of ingot exposed to the shock wave had a diameter of 190 mm and a length of 1.20 m. The processing produced fragments of semiconductor material in the tank with the following fragment size distribution:

| Fragment size (maximum dimension/cm) | Proportion (% by weight) |
|---|---|
| 0 to 1 | 2 |
| >1 to 4.5 | 3 |
| >4.5 to 7 | 15 |
| >7 to 12 | 75 |
| >12 | 5 |
| | 100% |

This size distribution is very highly suitable for subsequent use in the crucible pulling process.

Accordingly, while a few embodiments of the present invention have been shown and described, it is to be understood that many changes and modifications may be made thereunto without departing from the spirit and scope of the invention as defined in the appended claims.

What is claimed is:

1. A method for comminuting and cleaning semiconductor material, comprising providing a liquid medium and immersing a semiconductor material in rod form in said liquid medium;

generating one or more shock waves using a transducer;

transmitting said shock waves through said liquid medium to said semiconductor material in rod form immersed in said liquid medium;

said transducer being at a distance of from 1 cm to 100 cm from the semiconductor material;

said shock waves having a pulse energy of from 1 to 20 kJ and a pulse rise time to the energy maximum of from 1 to 5 $\mu$s; and wherein only one shock wave is used for disintegration of semiconductor material exposed.

2. The method as claimed in claim 1, wherein the transducer is at a distance of from 1 to 12 cm from a surface of the semiconductor material.

3. The method as claimed in claim 1, wherein the shock waves have a pulse energy of from 10 to 15 kJ.

4. The method as claimed in claim 1, wherein the shock waves have a pulse energy of from 11 to 13 kJ.

5. The method as claimed in claim 1, wherein the shock waves have a pulse rise time to the energy maximum of from 2 to 4 $\mu$s.

6. The method as claimed in claim 1, wherein from 1 to 20 transducers are used.

7. The method as claimed in claim 1, wherein a semiellipsoidal reflector is used as the transducer.

8. The method as claimed in claim 1, wherein respective pairs of transducers are arranged at an angle of 180° relative to each other.

* * * * *